US011839991B2

(12) United States Patent
Zhang et al.

(10) Patent No.: US 11,839,991 B2
(45) Date of Patent: Dec. 12, 2023

(54) CUSTOM-MADE BLINDS ANDSHADES CUTTING MACHINES

(71) Applicant: Mingyang Windeco Technology Corporation, Henan (CN)

(72) Inventors: Nianqing Zhang, Henan (CN); Shehua Wei, Henan (CN); Peilun Qian, Henan (CN)

(73) Assignee: MINGYANG WINDECO TECHNOLOGY CORPORATION, Henan (CN)

( * ) Notice: Subject to any disclaimer, the term of this patent is extended or adjusted under 35 U.S.C. 154(b) by 29 days.

(21) Appl. No.: 17/339,727

(22) Filed: Jun. 4, 2021

(65) Prior Publication Data

US 2022/0288801 A1 Sep. 15, 2022

(30) Foreign Application Priority Data

Mar. 15, 2021 (CN) ..... 202110275907.9
Mar. 15, 2021 (CN) ..... 202120533106.3

(51) Int. Cl.
*B26D 11/00* (2006.01)
*B26D 1/00* (2006.01)
(Continued)

(52) U.S. Cl.
CPC ..... *B26D 11/00* (2013.01); *B26D 1/0006* (2013.01); *B26D 1/105* (2013.01); *B26D 1/185* (2013.01);
(Continued)

(58) Field of Classification Search
CPC ..... B26D 11/00; B26D 5/10; E06B 9/266
See application file for complete search history.

(56) References Cited

U.S. PATENT DOCUMENTS 7,000,516 B2 * 2/2006 Lin ..... B23D 23/00 83/68
2002/0178884 A1 * 12/2002 Chuang ..... E06B 9/266 83/100

(Continued)

FOREIGN PATENT DOCUMENTS

CA 2550971 A1 * 12/2006 ..... B23D 23/00
CA 2668804 A1 * 12/2010 ..... B23D 23/00
EP 1514656 A1 * 3/2005 ..... B23D 59/001

*Primary Examiner* — Jennifer S Matthews
(74) *Attorney, Agent, or Firm* — Hamre, Schumann, Mueller & Larson, P.C.

(57) ABSTRACT

Disclosed is a customized blinds&shades cutting apparatus. The customized blinds&shades cutting apparatus comprises a working platform. The working platform is provided with a blinds&shades fabric cutting mechanism, a blinds&shades integrated cutting mechanism and an adjustable positioning mechanism. The blinds&shades fabric cutting mechanism comprises a first base, a first motor is fixedly mounted on the first base, a connected shaft is mounted on a rotating shaft of the first motor, and a cutter knife is further movably arranged on the first base; the blinds&shades integrated cutting mechanism comprises a second base, an aligning and cutting die is arranged on the second base, a cutting groove is formed on the working platform, the second base and the aligning and cutting die, and the blinds&shades integrated cutting mechanism further comprises saw webs corresponding to the cutting grooves in position. The customized blinds&shades cutting apparatus is novel in structure and ingenious in design. The customized blinds&shades cutting apparatus with a novel structure and an ingenious conception enables to manufacture clamps, housings, lower beams and lower round pipes of blinds&shadess with different sizes and models by using the blinds&shades fabric cutting mechanism, the blinds&shades integrated cutting mechanism and the adjustable positioning mechanism to clamp and
(Continued)

cut four profiles: a reel pipe, an upper housing, a lower beam and a lower round pipe, so that the processing efficiency is high.

9 Claims, 7 Drawing Sheets

(51) Int. Cl.
*B26D 1/10* (2006.01)
*B26D 5/10* (2006.01)
*B26D 1/18* (2006.01)

(52) U.S. Cl.
CPC ..... *B26D 5/10* (2013.01); *B26D 2001/004* (2013.01); *B26D 2001/0046* (2013.01); *B26D 2011/005* (2013.01)

(56) References Cited

U.S. PATENT DOCUMENTS

2004/0055436 A1* 3/2004 Parks ..... B27B 5/29 83/581
2005/0045012 A1* 3/2005 Nien ..... B23D 23/00 83/522.22
2005/0150344 A1* 7/2005 Nien ..... B26D 5/08 83/651
2007/0056419 A1* 3/2007 Tippmann ..... B26D 7/2635 83/531
2007/0277657 A1* 12/2007 Hilgendorf ..... B26D 3/16 83/13
2010/0199824 A1* 8/2010 Remmert ..... E06B 9/266 83/788
2010/0313726 A1* 12/2010 Lee ..... B23D 23/00 83/200

* cited by examiner

CUSTOM-MADE BLINDS ANDSHADES CUTTING MACHINES

FIELD OF TECHNOLOGY

The present invention relates to the technical field of blinds&shades processing, in particular to a custom-made blinds&shades cutting machines.

BACKGROUND

According to the existing blinds&shades cutting and restructuring machines in the market, as some fabrics to be cut for blinds&shades are irregular, the aesthetic degree of a blind or shade is decreased and it is inconvenient to mount the blind or shade. Parts needed to be cut off the blind or shade but cannot be cut at a time and the blind or shade can meet a using standard after being cut for many times, so the efficiency is low. Blinds&Shades processing machines using the previous techniques can only cut and restructure the blind or shade of one type, and are not suitable for blinds &shades of various types and are poor in universality.

In addition, a cutting knife is directly controlled to cut the blinds or shades by using the previous techniques. Due to the problem of the cutting knife, a cut is rough, so the repeated mounting of the blinds&shades is affected.

Therefore, a custom-made blinds &shades cutting machine is needed to solve this problem.

SUMMARY

In view of the above condition, in order to overcome defects of the previous techniques, the present invention aims to provide a custom-made cutting equipment, which solves the problem effectively.

The present invention has the beneficial effects that the custom-made blinds&shades cutting machine with a novel structure and an ingenious conception enables to manufacture clamps, housings, lower beams and lower round pipes of blinds&shades with different sizes and models by using the fabric cutting mechanism, the blinds&shades integrated cutting mechanism and the adjustable positioning mechanism to clamp and cut four profiles: a reel pipe, an upper housing, a lower beam and a lower round pipe, so that the processing efficiency is high and the custom-made blinds&shades cutting machine is convenient to use; rigid materials of the upper housings, the lower beams and the lower round pipes and flexible materials of the blinds&shades fabrics can be cut respectively by means of two different cutting modes: the saw webs and the cutting knife, and therefore, the cutting effect is good.

DESCRIPTION OF THE EMBODIMENTS

Further description of specific embodiments of the present invention in detail will be made below in combination with drawings.

EXAMPLES

Figure 1:
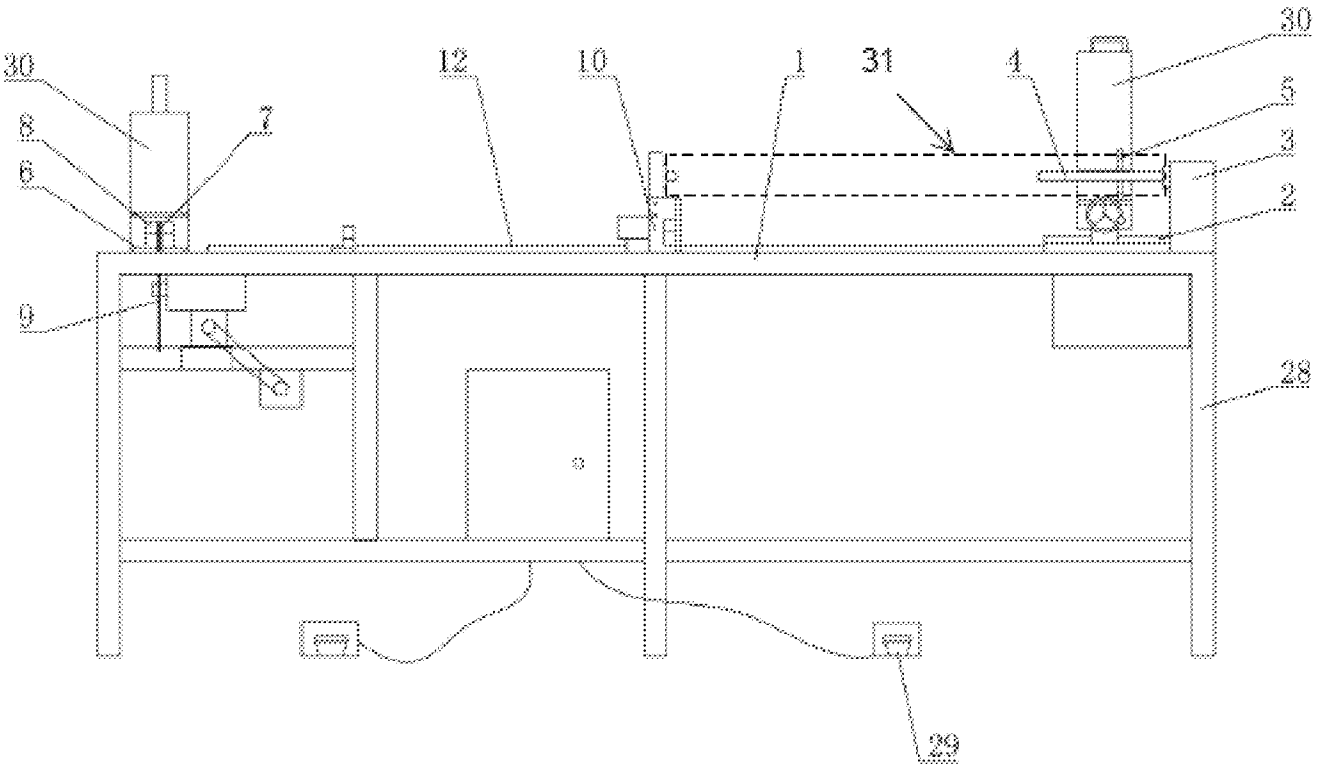
FIG. 1 is a main view of the present invention.
Figure 2:
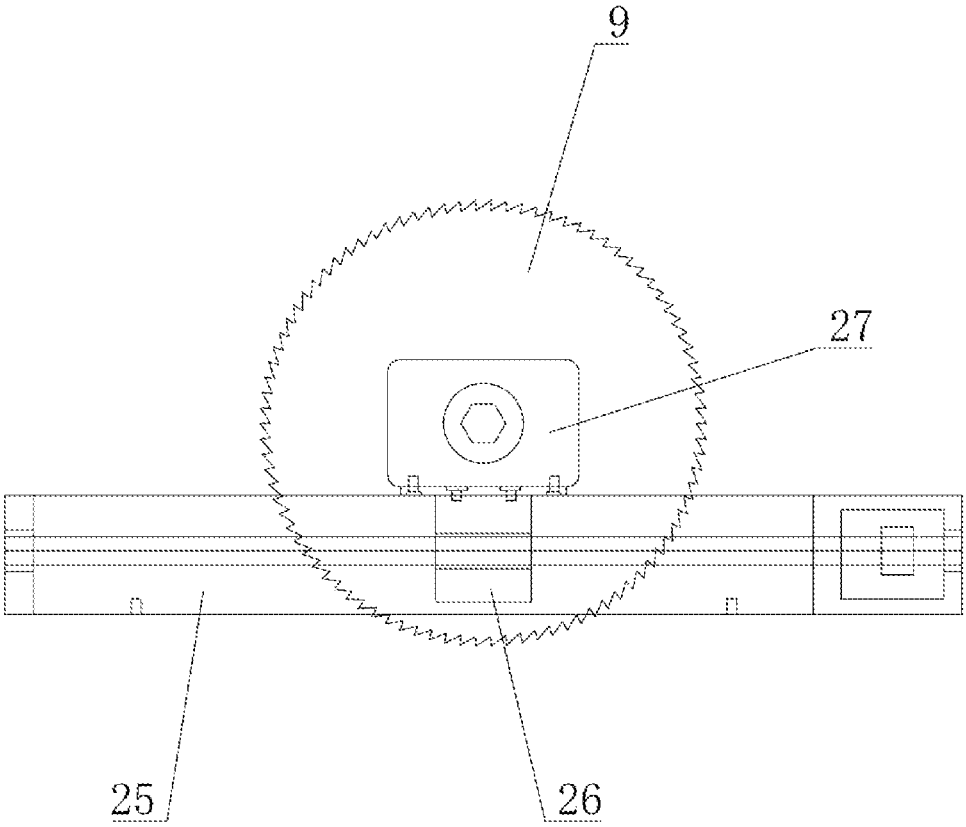
FIG. 2 is a main view of the saw webs of the present invention.
Figure 3:
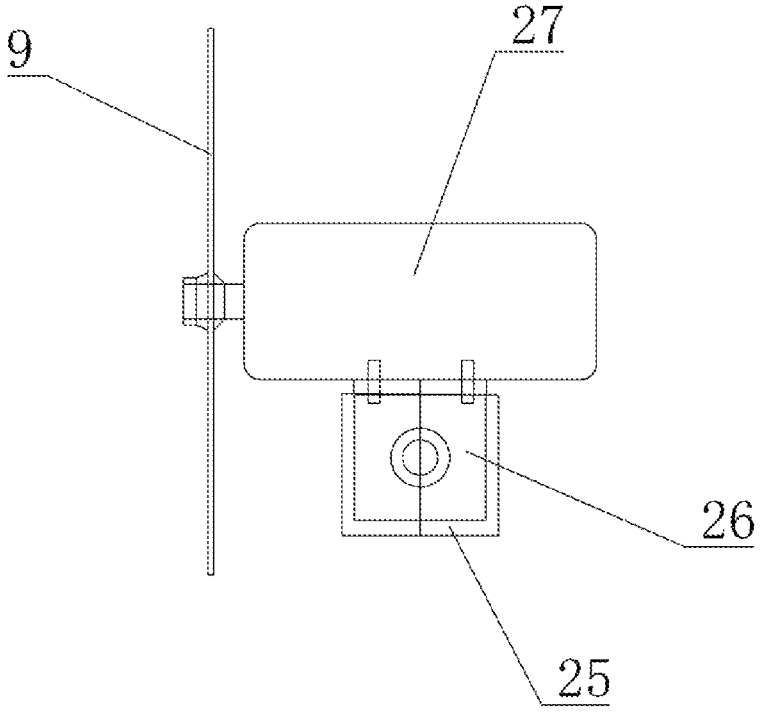
FIG. 3 is a side view of the saw webs of the present invention.
Figure 4:
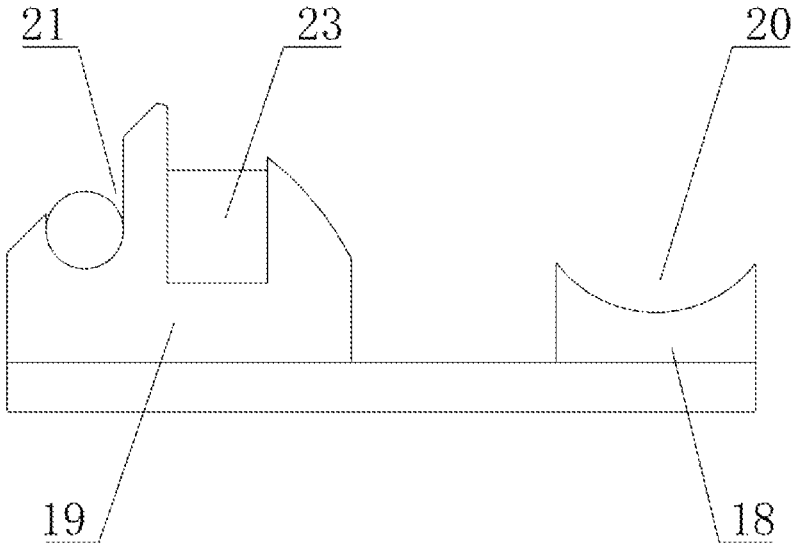
FIG. 4 is a main view of the positioning and cutting die of the present invention.
Figure 5:
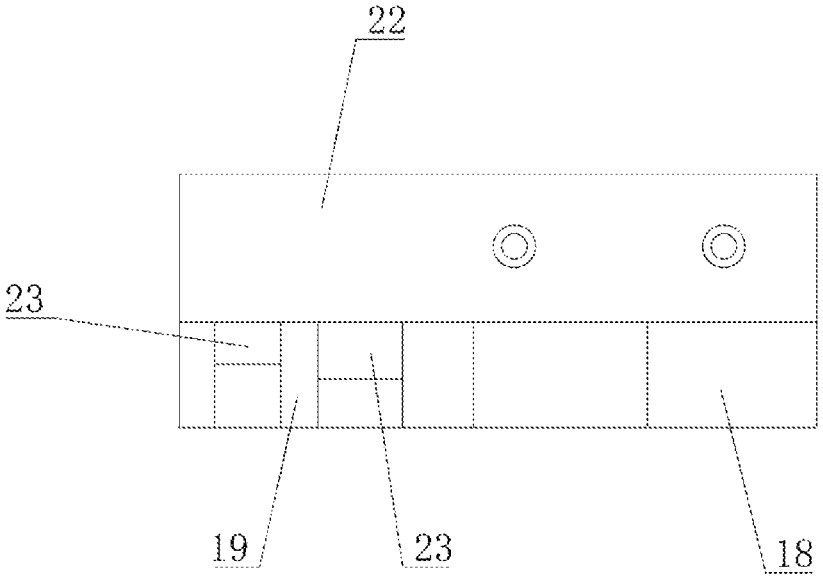
FIG. 5 is a top view of the positioning and cutting die of the present invention.
Figure 6:
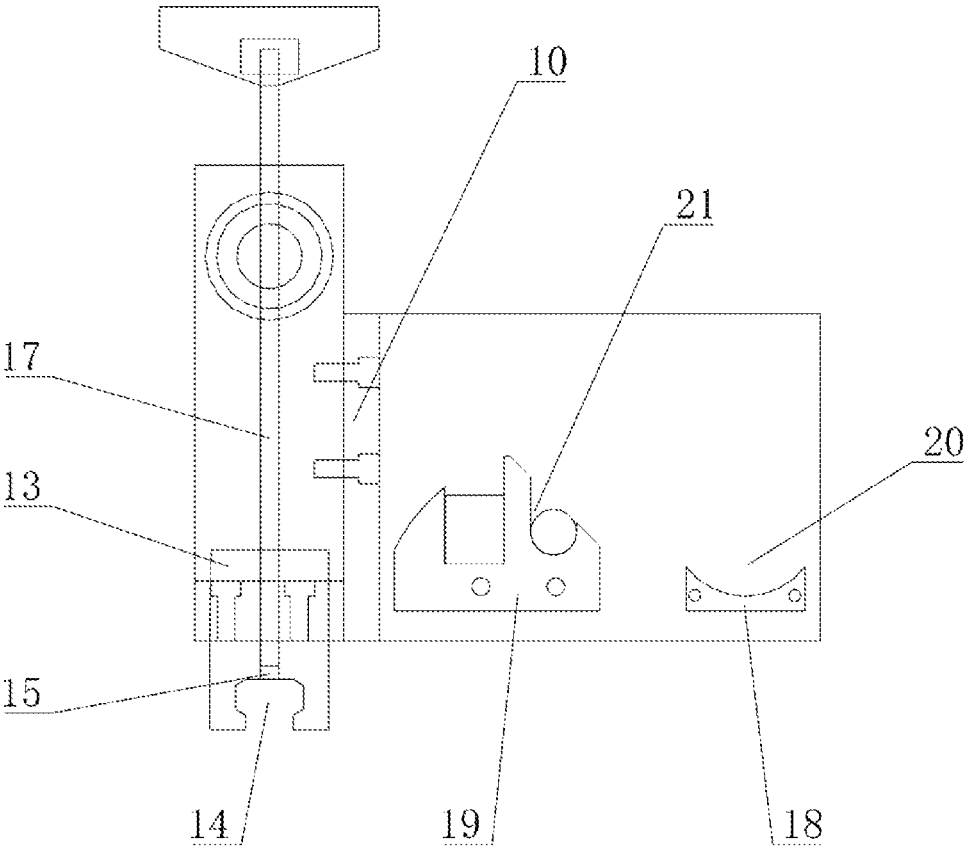
FIG. 6 is a main view of the third base of the present invention.
Figure 7:
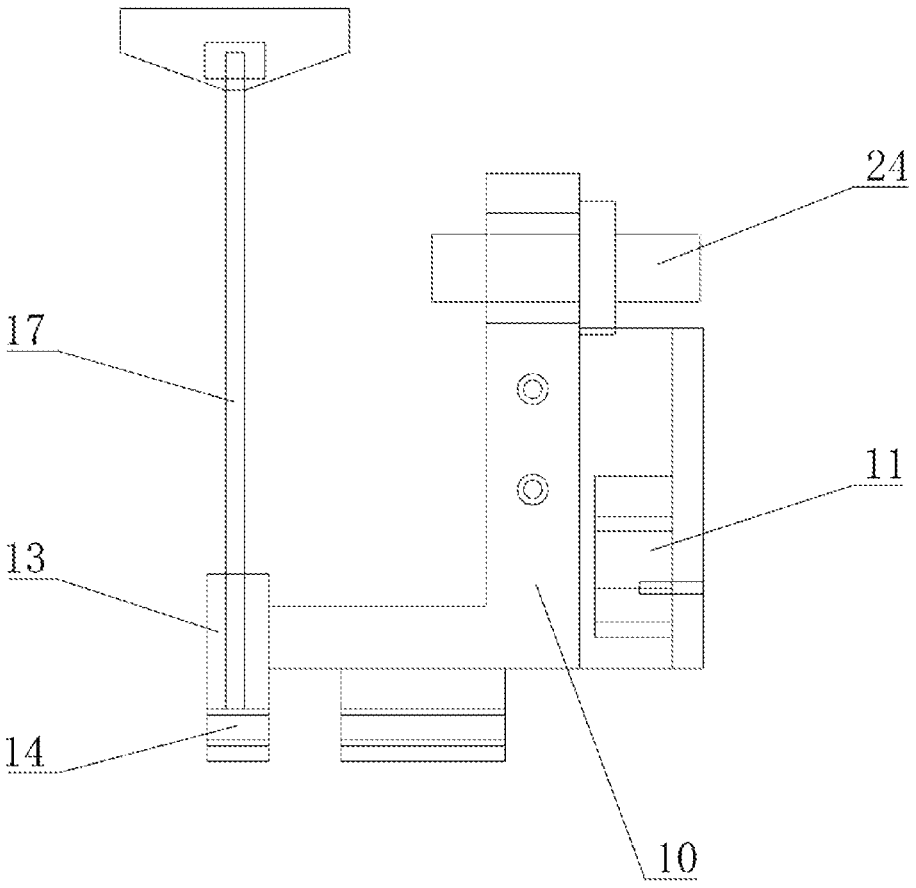
FIG. 7 is a side view of the third base of the present invention.

As shown in FIG. 1 to FIG. 7, the custom-made blind cutting machine includes a working platform 1, wherein the working platform 1 is provided with a blinds&shades fabric cutting mechanism, a blinds&shades integrated cutting mechanism and an adjustable positioning mechanism;

the blinds&shades fabric cutting mechanism includes a first base 2, a first motor 3 is fixedly mounted on the first base 2, a connected shaft 4 is mounted on a rotating shaft of the first motor 3, a sprag, as known in the art and not shown, is arranged on the connected shaft 4, a reel pipe 31 sleeving the blinds&shades fabric externally can be mounted on the connected shaft 4 and the reel pipe can rotate together with the connected shaft 4 via the clamping block matched with a slot in the reel pipe, as known in the art and not shown, and a cutter knife 5 is further movably arranged on the first base 2; when the first motor 3 drives the reel pipe to rotate, the cutting knife 5 is controlled to move toward the reel pipe perpendicularly, and the cutting knife 5 can cut the blinds&shades fabric mounted on the outer side of the reel pipe;

the blinds&shades integrated cutting mechanism includes a second base 6, an aligning and cutting die 8 is arranged on the second base 6, the reel pipe, the housing, the lower beam and the lower round pipe, as known in the art and now shown, sleeving the blinds&shades fabric externally can be mounted on the aligning and cutting die 8, and a cutting groove 7 is formed in the working platform 1, the second base 6 and the aligning and cutting die 8, and the blinds&shades integrated cutting mechanism further includes a saw web 9 corresponding to the cutting groove 7 in position and the saw web 9 are movably mounted on the working platform 1, and the rotating saw webs 9 cut the housing, the lower beam and the lower round pipe by moving the saw web 9 in a single direction; and the adjustable positioning mechanism includes a third base 10 movably arranged on the working platform 1, the third base 10 is provided with a positioning and cutting die 11, the third base 10 is further provided a fixing mechanism, and the fixing mechanism fixes the third base 10 to the working platform 1, and by adjusting the position of the third base 10, the reel pipe, the housing, the lower beam and the lower round pipe can be mounted on the aligning and cutting die 8 and the positioning and cutting die 11 simultaneously, the mounting stability of the reel pipe, the housing, the lower beam and the lower round pipe is enhanced, and a distance between the aligning and cutting die 8 and the positioning and cutting die 11 is determined, such that lengths of the cut housing, lower beam and lower round pipe are determined.

In order to make the third base 10 move on the working platform 1 and fix the third base on the working platform 1, the working platform 1 is provided with a first sliding rail 12, the first base 2 and the second base 6 are fixedly mounted at one end of the first sliding rail 12, the third base 10 is slidably mounted on the first sliding rail 12, a position between the first base 2 and the third base 10 or a position between the second base 6 and the third base 10 is controlled by adjusting a position of the third base 10, the positioning and cutting die 11 is mounted at the end, facing the second base 6, of the third base 10, the fixing mechanism includes a fixing block 13 fixedly connected to the second base 6, a sliding groove 14 is formed in the lower end of the fixing block 13, the second base 6 is slidably connected to the first sliding rail 12 through the sliding groove 14, the fixing block 13 is further internally provided with a threaded hole 15 communicating with the sliding groove 14, a screw 17 is mounted in the threaded hole 15 in a threaded manner, and the screw 17 is rotated, such that the screw 17 moves toward the sliding groove 14 till abutting against the first sliding rail 12, and thus, the third base 10 is fixed to the working platform 1.

The positioning and cutting die 11 structurally includes a blinds&shades fabric positioning die 18 and a blinds&shades body positioning die 19, an arc-shaped groove 20 is formed in an upper end surface of the blinds&shades fabric positioning die, the reel pipe can be put in the arc-shaped groove 20, a plurality of positioning grooves 21 are formed in an upper end of the blinds&shades body positioning die 19, the positioning grooves 21 are arc-shaped or rectangular grooves and the housing, the lower beam and the lower round pipe are embedded into the grooves respectively, and the aligning and cutting die 8 has the same structure as the positioning and cutting die 11 in structure, i.e. two ends of the reel pipe, the housing, the lower beam and the lower round pipe are mounted on the aligning and cutting die 8 and the positioning and cutting die 11 respectively.

In addition, as lengths needed by the reel pipe, the housing, the lower beam and the lower round pipe are different, in order to improve the processing efficiency when the housing, the lower beam and the lower round pipe are cut simultaneously by one saw web 9, the third base 10 is further provided with a backing plate 22, the backing plate 22 is provided with a plurality of adjusting protrusions 23 extending into arc-shaped groove 20 and positioning grooves 21 respectively, and the adjusting protrusions 23 can be different in thickness.

A positioning protrusion 24 arranged correspondingly to the connected shaft 4 is arranged at the end of the third base 10 facing the first base 2. When the third base 10 moves rightward to a corresponding position, the positioning protrusion 24 stretches into an end portion of the reel pipe mounted on the connected shaft 4, such that the stability of the reel pipe during rotation is guaranteed. The round pipes of different sizes are adjusted by adjusting or replacing the positioning protrusion 24, and can be used for blinds&shades of different models.

A second sliding rail 25 is arranged on a lower side of the working platform 1, a second motor 27 provided with the saw webs 9 is slidably mounted on the second sliding rail 25 through a first sliding seat 26, a third sliding rail perpendicular to the connected shaft 4 is provided on the first base 2, the connected shaft 4 and the third sliding rail are in horizontal states, the cutting knife 5 is slidably mounted on the third sliding rail through a second sliding seat, and the cutting knife 5 is sharp and smooth in cut and is clamped in a front supporting and back abutting manner. The working platform 1 is further provided with a first driving mechanism which drives the first sliding seat 26 to move on the second sliding rail 25 and a second driving mechanism which drives the second sliding seat to move on the third sliding rail. The first driving mechanism and the second driving mechanism can be either hydraulic rods or driving motors or the screw 17 rotates by means of a synchronizing wheel manually to control the sliding seat connected to the sliding rail to move on the sliding rail, and the cutting knife 5 or saw webs 9 are moved front and back to cut and process the reel pipe, the housing or the lower beam.

A plurality of supporting legs 28 are arranged at the lower end of the working platform 1.

In order to control the blinds&shades fabric cutting mechanism and the blinds&shades integrated cutting mechanism conveniently, two foot control switches 29 are further arranged on the lower side of the working platform 1, the two foot control switches 29 being connected to the first motor 3 and the second motor 27 through a power distribution cabinet respectively.

A protective cover 30 is rotatably mounted at one ends of the first base 2 and the second base 6, the protective covers 30 being provided with processing opening. The protective covers 30 can shield parts of the housing, the lower beam and the lower round pipe by rotating the protective covers 30, such that the protective covers play a protecting role when the saw webs 9 or the cutting knife 5 cut the blinds &shades.

When the custom-made blinds&shades cutting machine is used, the lengths of the reel pipe and the blinds&shades fabric are determined, the reel pipe sleeving the blinds&shades fabric externally is mounted in a proper position of the connected shaft 4, and the third base 10 is moved, such that the positioning protrusion 24 on the third base 10 positions and fixes the reel pipe and aligns the front and back ends of the blinds&shades fabric, the protective covers 30 are rotated, such that the protective covers 30 shield one ends of the cutting knife 5 and the reel pipe, the connected shaft 4 is controlled by the foot control switches 29 to rotate, so that the reel pipe rotates, and at the time, the cutting knife 5 is controlled to move toward the reel pipe, and observed from observation windows in the protective covers 30, the cutting knife 5 cuts the blinds&shades fabric.

The reel pipe is taken down, the position of the third base 10 is adjusted, the reel pipe is mounted on the aligning and cutting die 8 and the positioning and cutting die 11, the end portion of the reel pipe is attached to the edges of the cutting grooves 7, and then the housing, the lower beam and the lower round pipe are mounted in the plurality of positioning grooves 21, such that the end portions of the housing, the lower beam and the lower round pipe abut against the adjusting protrusions 23, and therefore, distances between the ends, connected to the adjusting protrusions 23, of the reel pipe, the housing, the lower beam and the lower round pipe and the saw webs 9 and those between the ends and the cutting grooves 7 reach set values. The protective covers 30 are rotated, such that the protective covers 30 shield one ends of the housing, the lower beam, the lower round pipe and the saw webs 9. The connected shaft 4 is controlled by the foot control switches 29 to rotate, such that the saw webs 9 rotate, and at the moment, the saw webs 9 are controlled to move toward the housing, the lower beam and the lower round pipe. Observed from the observation windows in the protective covers 30, the cutting knife 5 cuts the housing, the lower beam and the lower round pipe.

The present invention has the beneficial effects that the custom-made blinds&shades cutting machine with a novel structure and an ingenious conception enables to manufacture clamps, housings, lower beams and lower round pipes of blinds&shades with different sizes and models by using the blinds&shades fabric cutting mechanism, the blinds&shades integrated cutting mechanism and the adjustable positioning mechanism to clamp and cut four profiles:

a reel pipe, an upper housing, a lower beam and a lower round pipe, so that the processing efficiency is high and the custom-made blinds&shades cutting machine is convenient to use; rigid materials of the upper housings, the lower beams and the lower round pipes and flexible materials of blinds&shades fabrics can be cut respectively by means of two different cutting modes: the saw webs 9 and the cutting knife 5, and therefore, the cutting effect is good.

The above specific modes of execution/embodiments which are specific modes of execution of the present invention for illustrating the conception of the present invention are explanatory and exemplary and should not be construed as limitations to the modes of execution of the present invention and the scope of the of the present invention. Besides the embodiments recorded herein, those skilled in the art further can adopt other obvious technical schemes based on contents disclosed in claims and description of the disclosure. These technical schemes including those adopting any obvious replacements and modifications made to the embodiments recorded herein shall fall within the scope of protection of the present invention. In particular, provided no structural conflict exists, the technical features mentioned in the embodiments can be combined in any way. The present invention is not limited to specific embodiments disclosed herein, and will include all embodiments falling within the scope of the claims.

What is claimed is:

1. A customized blinds&shades cutting apparatus, comprising a working platform (1), wherein the working platform (1) is provided with a blinds&shades fabric cutting mechanism, a blinds&shades integrated cutting mechanism and an adjustable positioning mechanism;

the blinds&shades fabric cutting mechanism comprises a first base (2), a first motor (3) fixedly mounted on the first base (2), a connected shaft (4) mounted to the first motor (3), and a cutting knife (5) movably arranged on the first base (2), wherein the blinds&shades fabric cutting mechanism is configured such that the first motor is configured to rotate the connected shaft, wherein the connected shaft is configured to receive a reel pipe sleeving blinds&shades fabric, and the cutting knife (5) is configured to move perpendicularly toward and away from the connected shaft such that the cutting knife (5) is configured to cut the blinds&shades fabric on an outer side of the reel pipe, wherein the cutting knife (5) is configured to move perpendicularly toward and away from the connected shaft by being slidably mounted on a sliding seat on a sliding rail that is perpendicular to the connected shaft (4);

the blinds&shades integrated cutting mechanism is on an opposite end of the working platform than the blinds&shades fabric cutting mechanism, the blinds&shades integrated cutting mechanism comprising a second base (6), an aligning and cutting die (8) arranged on the second base (6) and a cutting groove (7) formed in the working platform (1), the second base (6) and the aligning and cutting die (8), and the blinds&shades integrated cutting mechanism further comprises a saw web (9) corresponding to the cutting grooves (7) in position and the saw web (9) is movably mounted on the working platform (1); and the adjustable positioning mechanism comprises a third base (10) movably arranged on the working platform (1), the third base (10) is provided with a positioning and cutting die (11), the third base (10) is further provided with a fixing mechanism, and the fixing mechanism fixes the third base (10) to the working platform (1).

2. The customized blinds&shades cutting apparatus according to claim 1, wherein the working platform (1) is provided with a first sliding rail (12), the first base (2) and the second base (6) are fixedly mounted at one end of the first sliding rail (12), the third base (10) is slidably mounted on the first sliding rail (12), the positioning and cutting die (11) is mounted at the end of the third base (10) facing the second base (6), the fixing mechanism comprises a fixing block (13) fixedly connected to the second base (6), a sliding groove (14) is formed in the lower end of the fixing block (13), the second base (6) is slidably connected to the first sliding rail (12) through the sliding groove (14), a threaded hole (15) communicating with the sliding groove (14) is further provided within the fixing block (13), and a screw (17) is mounted in the threaded hole (15) in a threaded manner.

3. The customized blinds&shades cutting apparatus according to claim 1, wherein the positioning and cutting die (11) is configured for mounting at least the reel pipe and structurally comprises a blinds&shades fabric positioning die (18) and a blinds&shades body positioning die (19), an arc-shaped groove (20) is formed in an upper end surface of the blinds&shades fabric positioning die, a plurality of positioning grooves (21) are formed in an upper end of the blinds&shades body positioning die (19), the positioning grooves (21) are arc-shaped or rectangular grooves, and the aligning and cutting die (8) has the same structure as the positioning and cutting die (11).

4. The customized blinds&shades cutting apparatus according to claim 3, wherein the third base (10) is further provided with a backing plate (22), and the backing plate (22) is provided with a plurality of adjusting protrusions (23) extending into the arc-shaped groove (20) and the plurality of positioning grooves (21) respectively.

5. The customized blinds&shades cutting apparatus according to claim 1, wherein a positioning protrusion (24) arranged correspondingly to the connected shaft (4) is arranged at the end of the third base (10) facing the first base (2) and configured to receive the reel pipe.

6. The customized blinds&shades cutting apparatus according to claim 1, wherein a second sliding rail (25) is arranged on a lower side of the working platform (1), a second motor (27) provided with the saw web (9) is slidably mounted on the second sliding rail (25) through a first sliding seat (26), and the working platform (1) is further provided with a first driving mechanism driving the first sliding seat (26) to move on the second sliding rail (25) and a second driving mechanism driving the second sliding seat to move on the third sliding rail.

7. The customized blinds&shades cutting apparatus according to claim 1, wherein a plurality of supporting legs (28) are arranged at the lower end of the working platform (1).

8. The customized blinds&shades cutting apparatus according to claim 1, wherein two foot control switches (29) are further arranged on the lower side of the working platform (1), the two foot control switches (29) being connected to the first motor (3) and the second motor (27) respectively.

9. The customized blinds&shades cutting apparatus according to claim 1, wherein a protective cover (30) is rotatably mounted at one ends of the first base (2) and the second base (6), the protective covers (30) being provided with processing openings.

* * * * *